US009509064B2

(12) United States Patent
Mitsui et al.

(10) Patent No.: US 9,509,064 B2
(45) Date of Patent: Nov. 29, 2016

(54) TERMINAL FITTING

(71) Applicant: Sumitomo Wiring Systems, Ltd., Yokkaichi, Mie (JP)

(72) Inventors: Shohei Mitsui, Mie (JP); Masahito Matsuura, Mie (JP)

(73) Assignee: Sumitomo Wiring Systems, Ltd. (DE)

( * ) Notice: Subject to any disclaimer, the term of this patent is extended or adjusted under 35 U.S.C. 154(b) by 0 days.

(21) Appl. No.: 14/648,916

(22) PCT Filed: Oct. 16, 2013

(86) PCT No.: PCT/JP2013/078029
§ 371 (c)(1),
(2) Date: Aug. 5, 2015

(87) PCT Pub. No.: WO2014/091820
PCT Pub. Date: Jun. 19, 2014

(65) Prior Publication Data

US 2016/0006137 A1 Jan. 7, 2016

(30) Foreign Application Priority Data

Dec. 10, 2012 (JP) ..... 2012-269538

(51) Int. Cl.
*H01R 4/10* (2006.01)
*H01R 4/18* (2006.01)
*H01R 13/11* (2006.01)

(52) U.S. Cl.
CPC ..... *H01R 4/185* (2013.01); *H01R 13/11* (2013.01)

(58) Field of Classification Search
CPC ..... H01R 4/18; H01R 4/183; H01R 4/185
USPC ..... 439/877, 878
See application file for complete search history.

(56) References Cited

U.S. PATENT DOCUMENTS

| | | | |
|---|---|---|---|
| 6,068,527 | A | 5/2000 | Ohsumi et al. |
| 7,905,745 | B2 | 3/2011 | Watanabe et al. |
| 2013/0126236 | A1 | 5/2013 | Suzuki et al. |

FOREIGN PATENT DOCUMENTS

| | | |
|---|---|---|
| JP | 11-219769 | 8/1999 |
| JP | 2005-302560 | 10/2005 |
| JP | 2010-140651 | 6/2010 |
| WO | 2012/029352 | 3/2012 |

OTHER PUBLICATIONS

International Search Report of Dec. 3, 2013.

*Primary Examiner* — Khiem Nguyen
(74) *Attorney, Agent, or Firm* — Gerald E. Hespos; Michael J. Porco; Matthew T. Hespos

(57) ABSTRACT

A terminal fitting (F) is such that a main body portion (10) in the form of a rectangular tube and a crimping portion (21) to be crimped to an end of a wire (Wa) are coupled by a substantially U-shaped neck portion (30) in which side plates (31) stand up from opposite side edges of a bottom plate (11), and the crimping portion (21) is so squeezed to provide a bell mouth (25) on a front end. The neck portion (30) is so formed that upper edges (32) of the side plates (31) continuously extend from a top (25A) of the bell mouth (25) and are located at height positions not lower than the top (25A). The upper edges (32) of the side plates (31) of the neck portion (30) are so inclined as to gradually increase a height from a rear end toward a front end.

5 Claims, 7 Drawing Sheets

TERMINAL FITTING

BACKGROUND

1. Field of the Invention

The present invention relates to a terminal fitting to be connected to an end of a wire.

2. Description of the Related Art

A terminal fitting is formed by press-working a metal plate with excellent electrical conductivity. For example, if a general structure of a female terminal is described with reference to FIG. 7 showing a comparative example, a main body portion 1 in the form of a rectangular tube to be connected to a mating male terminal is provided on a front end side, a wire barrel 2 and an insulation barrel 3 of an open-barrel type to be caulked and crimped to an end of an insulated wire W are provided on a rear end side, and the rear end of the main body portion 1 and the front end of the wire barrel 2 are coupled by a substantially U-shaped neck portion 4 in which side plates 6 stand up from opposite side edges of a bottom plate 5. In connecting the female terminal to the end of the insulated wire W, the wire barrel 2 is caulked and crimped to an end of a core Wa and the insulation barrel 3 is caulked and crimped to an end of an insulation coating Wb.

Here, bell mouths 2A flared open toward an outer side are also formed on opposite front and rear ends of the wire barrel 2 to prevent the breakage of the core Wa by the edges of barrel pieces. Further, the neck portion 4 as a coupling portion is U-shaped as described above so as to be coupled to the main body portion 1 while ensuring to be caulked and crimped into a proper shape without causing the breakage of the wire barrel 2 and the like. Such a female terminal is disclosed in Japanese Unexamined Patent Publication No. 2005-302560.

In recent years, there has been a tendency to miniaturize terminal fittings and the thinning of a metal plate as a base material has been adopted as one measure therefor. However, if the metal plate is thinned, deformation such as breakage easily occurs, i.e. there is a risk of insufficient strength in the above female terminal when an external force is applied particularly because the neck portion 4 is substantially U-shaped to have an open surface. Thus, a countermeasure against that has been desired.

The present invention was completed based on the above situation and aims to provide a terminal fitting realizing a strength increase of a neck portion only by being accompanied by a slight design change.

SUMMARY OF THE INVENTION

The present invention is directed to a terminal fitting in which a main body portion in the form of a rectangular tube and a crimping portion to be crimped to an end of a wire are coupled by a substantially U-shaped neck portion in which side plates stand up from opposite side edges of a bottom plate, and the crimping portion is so squeezed to provide a bell mouth on a front end, wherein the neck portion is so formed that upper edges of the side plates continuously extend from a top of the bell mouth and are located at height positions not lower than the top by being extended upwardly in flush with the side plates.

According to the above configuration, areas of the side plates in a height direction are increased by elevating the height positions of the entire upper edges by setting starting points of the upper edges of the side plates higher, and bending rigidity is better accordingly. Further, there is no position of stress concentration since the upper edges of the side plates are continuously formed without forming any step from the top of the bell mouth. As a result, strength is increased to resist the breakage of the neck portion and the like.

Further, the elevation of the upper edges of the side plates of the neck portion can be dealt with only by changing a design so that a width of a development part constituting the neck portion is widened by a predetermined amount in a die of a press machine for cutting a development shape of this terminal fitting from a metal plate as a base material. Furthermore, an increase in the areas of the side plates can be covered by parts of the metal plate as the base material to be originally discarded after the cutting of the development shape. Thus, material cost is not increased. As a result, a design change can be inexpensively dealt with.

The upper edges of the side plates of the neck portion may be so inclined as to gradually increase a height from a rear end toward a front end. According to this configuration, stress concentration at intermediate positions of the upper edges is avoided and the breakage of the neck portion and the like can be more reliably prevented.

Further, the crimping portion may be an open barrel, in which barrel pieces stand up from opposite side edges of a bottom plate, and caulked and crimped into a substantially heart shape such that projecting edges of the both barrel pieces bite into the wire while butting against each other by being squeezed between an anvil and a crimper after the wire is placed on the bottom plate, and the bell mouth may be formed at least on the front end.

According to the terminal fitting of the present invention, it is possible to realize a strength increase of a neck portion only by being accompanied by a slight design change.

DETAILED DESCRIPTION

Hereinafter, an embodiment of the present embodiment is described in detail with reference to FIGS. 1 to 6.

Figure 1:
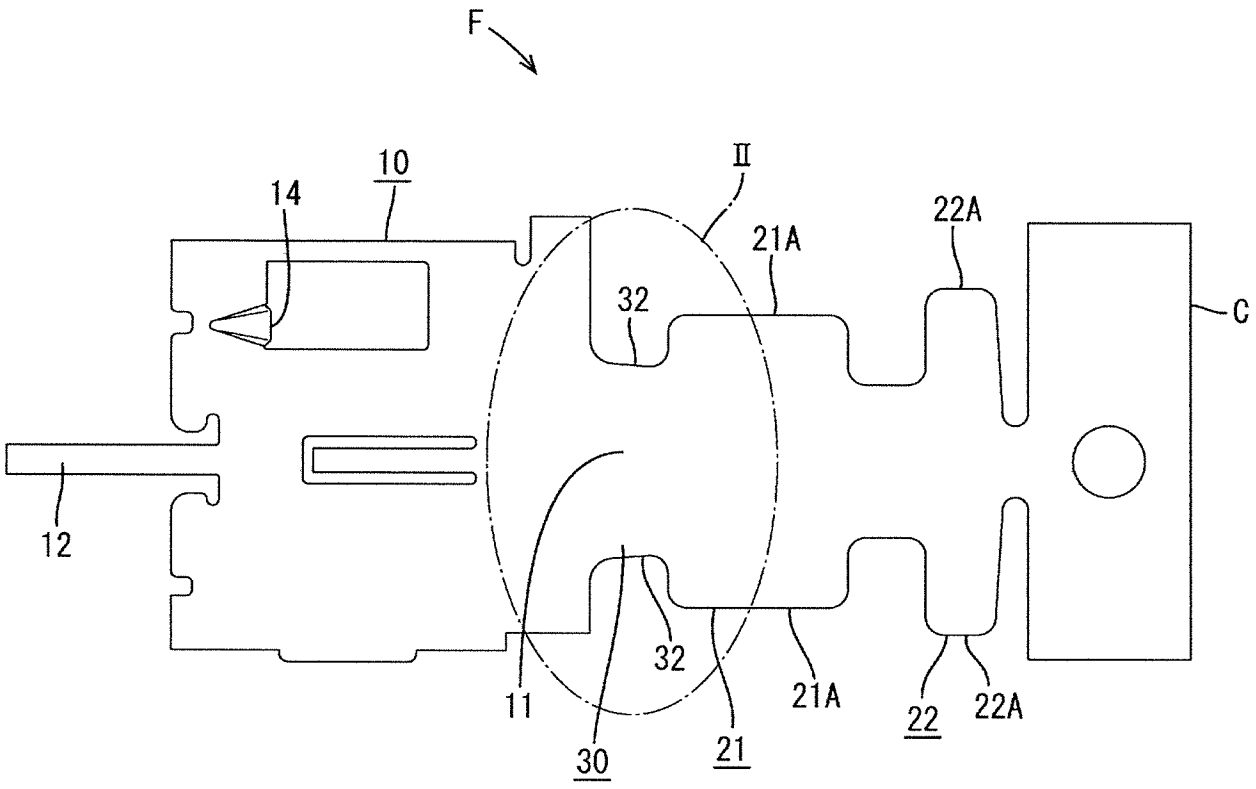
FIG. 1 is a development of a female terminal according to one embodiment of the present invention.
Figure 3:
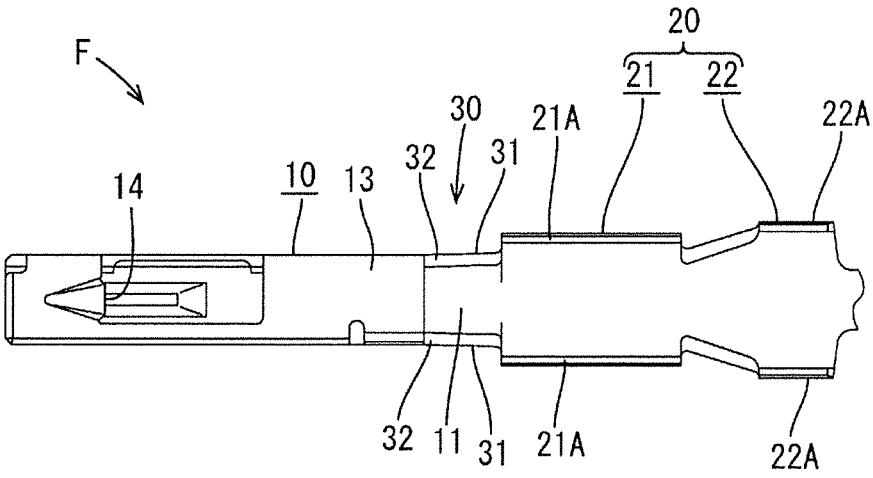
FIG. 3 is a plan view of the female terminal.
Figure 4:
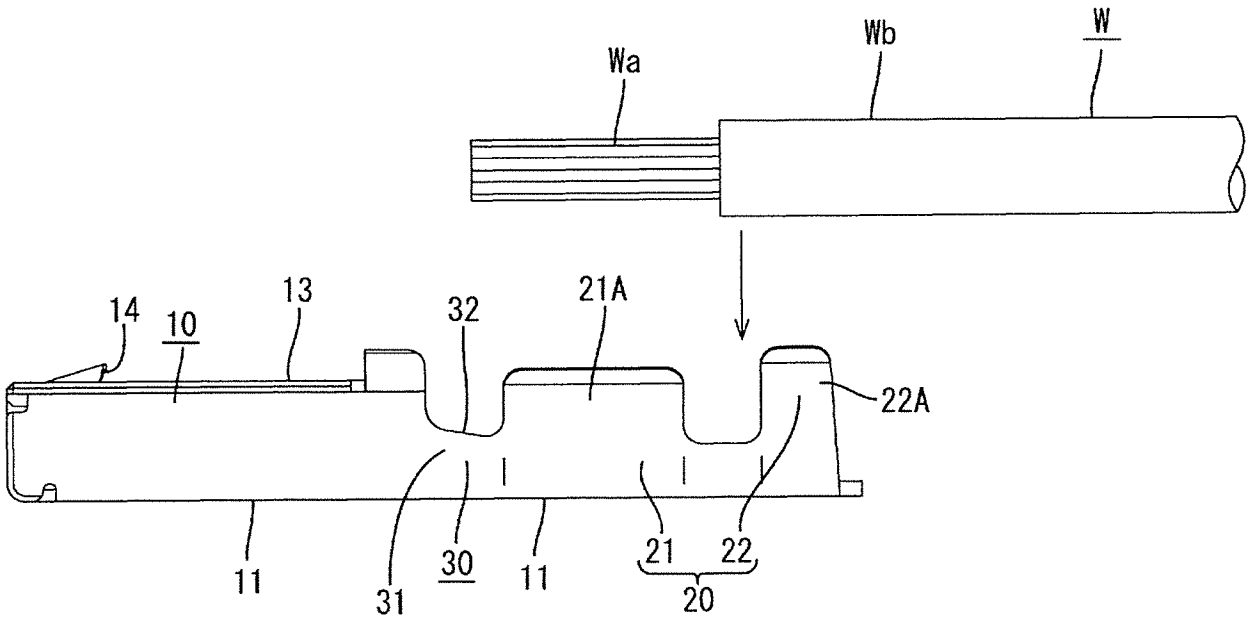
FIG. 4 is a side view showing a connecting operation of an insulated wire.

A female terminal F of this embodiment is formed by press-working a metal plate with excellent electrical conductivity and formed into a shape as shown in FIGS. 3 and 4 by performing a punching process and a bending process a plurality of times while the female terminal F is intermittently conveyed via a carrier C after being cut into a development shape shown in FIG. 1.

Figure 5:
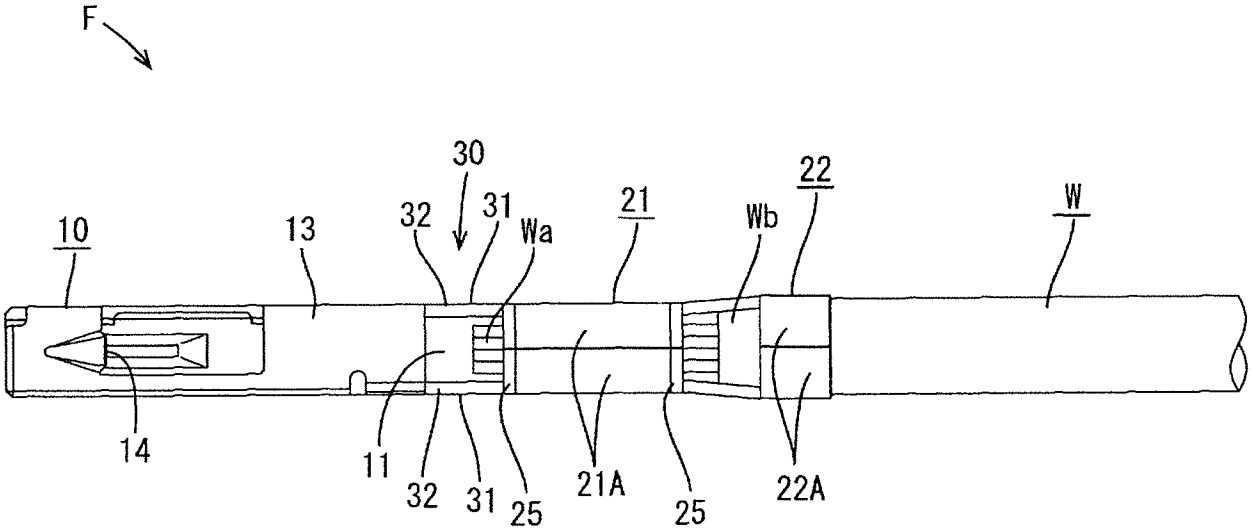
FIG. 5 is a plan view of the female terminal in a state connected to an end of the insulated wire.
Figure 6:
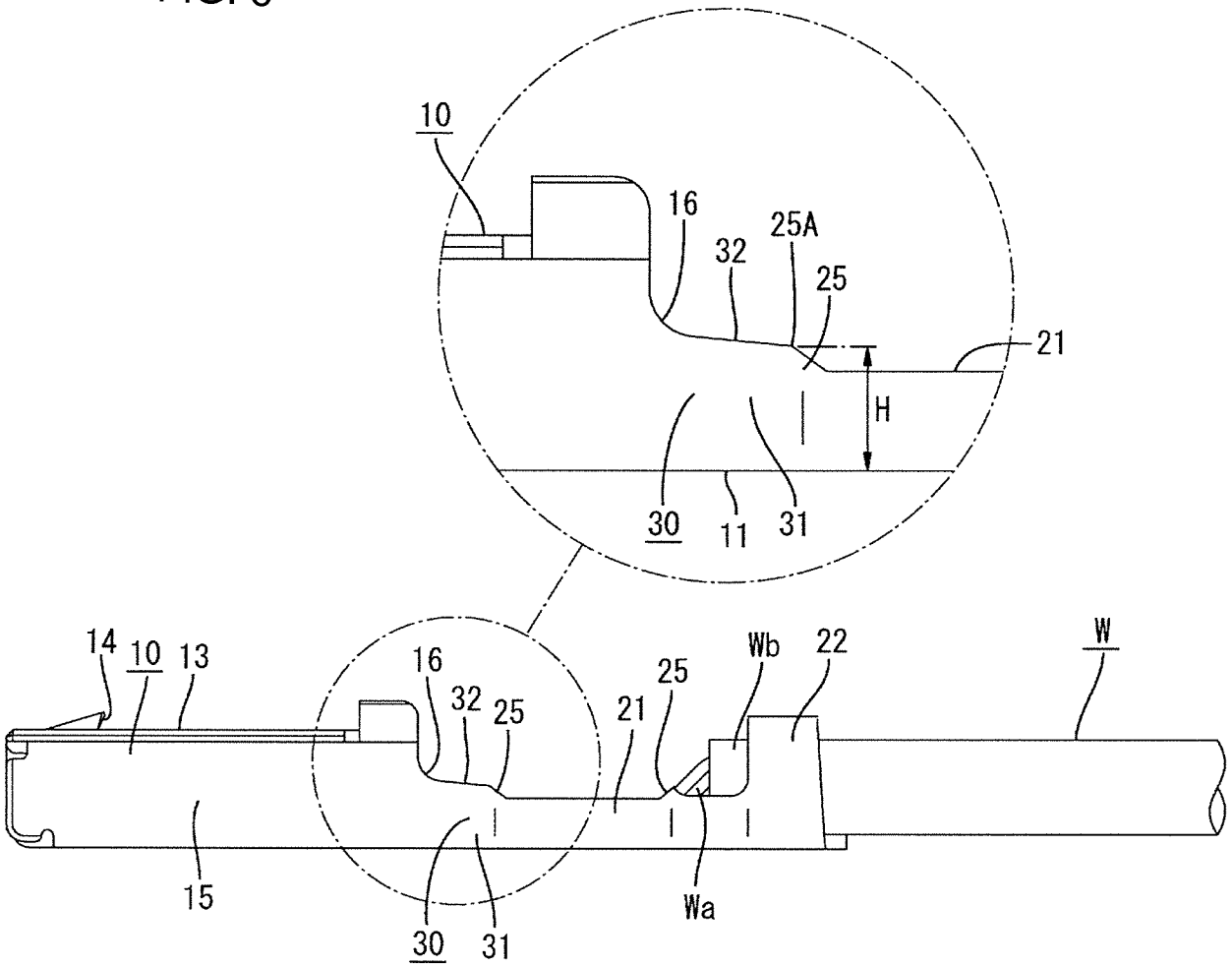
FIG. 6 is a side view of the female terminal in the state of FIG. 5.

As described later, the female terminal F is cut off from the carrier C simultaneously with a crimping process to an insulated wire W, thereby obtaining a final shape as shown in FIGS. 5 and 6, and accommodated into a cavity of an unillustrated housing while being retained The structure of the female terminal F is described again. As shown in FIGS. 3 and 4, the female terminal F has a long and narrow shape in a front-back direction as a whole, a main body portion 10 into which a tab of an unillustrated mating male terminal is to be inserted for connection is formed on a front end side, whereas a crimping portion 20 to be crimped to an end of the insulated wire W is formed on a rear end side, and the rear end of the main body portion 10 and the front end of the crimping portion 20 are connected by a neck portion 30.

The main body portion 10 is formed into a rectangular tube shape with open front and rear surfaces, and a resilient contact piece 12 to be resiliently brought into contact with the tab of the mating male terminal is accommodated in the main body portion 10 by folding a tongue piece extending from the front edge of a bottom plate 11. A lance locked portion 14 to be locked by a locking lance provided in the cavity of the housing is formed on a ceiling plate 13 of the main body portion 10, and a retainer for double locking can lock the rear edge of a ceiling side of the main body portion 10.

In the crimping portion 20, a wire barrel 21 to be caulked and crimped to an end of the core Wa exposed on the insulated wire W and an insulation barrel 22 to be caulked and crimped to an end of the insulation coating Wb are arranged while being spaced apart in the front-back direction. The wire barrel 21 has a longer length in the front-back direction than the insulation barrel 22.

The wire barrel 21 is formed such that barrel pieces 21A having a short height stand up from left and right side edges of the bottom plate 11 common to the main body portion 10 while being slightly more spaced apart toward an upper side. Serration 24 is formed on the entire inner surface of the wire barrel 21.

The insulation barrel 22 is formed such that barrel pieces 22A having a tall height likewise stand up from the left and right side edges of the bottom plate 11 while being slightly more spaced apart toward an upper side.

In connecting the female terminal F to the end of the insulated wire W, the female terminal F is so set in a crimping apparatus that the end of the core Wa is placed on the bottom plate 11 of the wire barrel 21 and the end of the insulation coating Wb is placed on the bottom plate 11 of the insulation barrel 22 as shown in FIG. 4, and the both barrels 21, 22 are squeezed between an anvil and a crimper to be so-called caulked and crimped.

The insulation barrel 22 is caulked and crimped to the end of the insulation coating Wb by the both barrel pieces 22A.

The wire barrel 21 is caulked and crimped to the end of the core Wa while forming a substantially heart shape such that the projecting edges of the both barrel pieces 21A bite into the outer periphery of the wire Wa while butting against each other. Here, bell mouths 25 flared open toward an outer side are formed on opposite front and rear ends of the wire barrel 21 to prevent the breakage of the core Wa by side edges of the barrel pieces 21A.

The front end of this wire barrel 21 and the rear end of the main body portion 10 described above are coupled by the neck portion 30. In the neck portion 30, a pair of side plates 31 likewise stand up from left and right side edges of the bottom plate 11 common to the main body portion 10 to form a substantially U shape, and the left and right side plates 31 stand up in parallel to each other while having the same width as the main body portion 10 and the wire barrel 21 in a final shape after the barrels 21, 22 are caulked and crimped. The wire barrel 21 is substantially U-shaped in this way to enable the wire barrel 21 to be coupled to the main body portion 10 while ensuring that the wire barrel 21 is caulked and crimped into a proper shape without causing breakage and the like.

In this embodiment, the height positions of upper edges 32 of the left and right side plates 31 in the neck portion 30 are improved.

Figure 7:
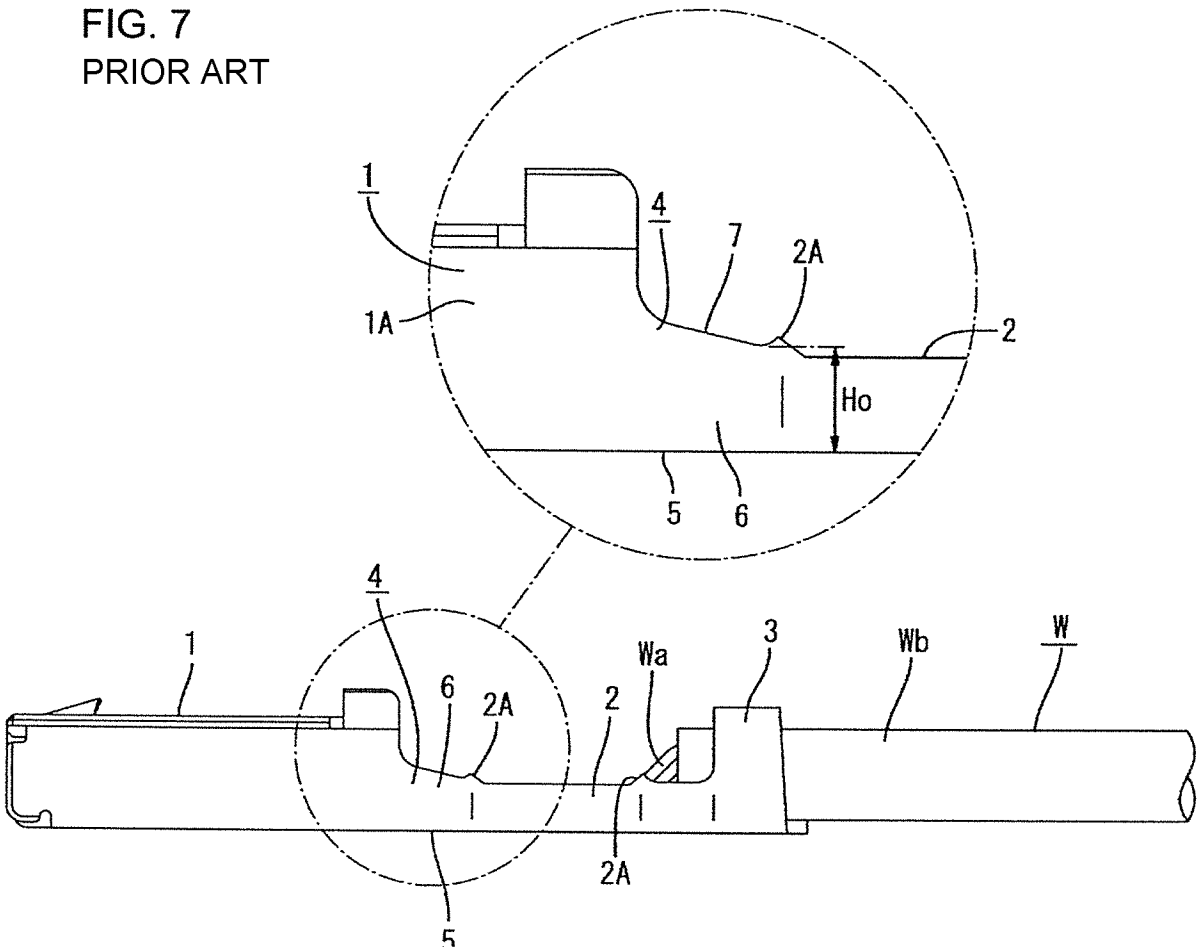
FIG. 7 PRIOR ART
FIG. 7 is a side view of a female terminal according to a comparative example.

Conventionally, as shown in the comparative example of FIG. 7, the upper edges 7 of the side plates 6 of the neck portion 4 generally extend forward with an upward inclination from starting points (rear ends) slightly higher than the upper surface of the crimped wire barrel 2, in other words, slightly lower than the top of the front bell mouth 2A, and the front ends reach predetermined coupling positions slightly above central positions of the rear edges of left and right side plates 1A of the main body portion 1 in the height direction.

Contrary to that, in this embodiment, the upper edges 32 of the side plates 31 of the neck portion 30 extend forward with a slightly more moderate upward inclination than in the above comparative example from a top 25A of the bell mouth 25 as starting points (rear ends) and reach predetermined coupling positions 16 (same as in the above comparative example) slightly above central positions of the rear edge of the left and right side plates 15 of the main body portion 10 in a height direction as shown in FIG. 6. Note that curved front end parts of the upper edges 32 of the side plates 31 are connected to the rear edges of the side plates 15 of the main body portion 10.

More specifically, a height H of the rear ends of the upper edges 32 in the side plates 31 of the neck portion 30 of this embodiment is larger than a height Ho (see FIG. 7) of the rear ends of the upper edges in the side plates 6 of the comparative example by Δh. This difference is gradually reduced from the rear end to the front end, but the upper edges 32 of the side plates 31 of this embodiment are constantly located to be higher than the upper edges 7 of the side plates 6 of the comparative example.

Figure 2:
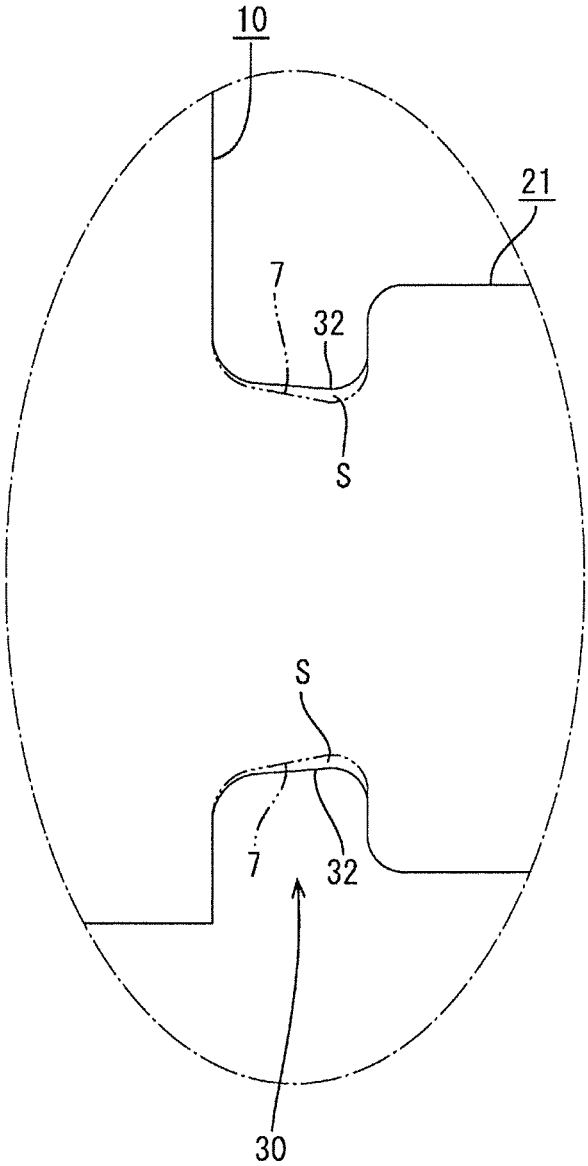
FIG. 2 is an enlarged view of a part II of FIG. 1.

Looking at a development shape, a development part constituting the neck portion 30 is in the form of a short strip gradually narrowed from the rear edge of a development part of the main body portion 10 toward the front edge of a development part of the wire barrel 21 as shown in FIG. 2. Here, rear sides of left and right edges (corresponding to the upper edges 7 of the side plates 6) in a development part of the neck portion 4 are relatively steeply narrowed in the comparative example as shown by chain lines in FIG. 2, whereas rear sides of the left and right edges (corresponding to the upper edges 32 of the side plates 31) are relatively moderately narrowed in the development part of the neck portion 30 of this embodiment as shown by solid lines in FIG. 2. As a result, left and right edge parts (upper edge parts of the side plates 31) of the development part have a larger area S as compared with the comparative example.

As described above, in the female terminal F of this embodiment, the upper edges 32 of the side plates 31 of the neck portion 30 are formed to extend with an upward inclination from the top 25A of the bell mouth 25 formed on the front end of the wire barrel 21 as the starting points and reach the main body portion 10. Specifically, areas of the side plates 31 in the height direction are increased by elevating the height positions of the entire upper edges 32 by setting the starting points of the upper edges 32 of the side plates 31 higher, and bending rigidity is better accordingly. Further, there is no position of stress concentration since the upper edges of the side plates 31 are continuously formed without forming any step from the top 25A of the bell mouth 25. As a result, strength is increased to resist the breakage of the neck portion 30 and the like.

The elevation of the upper edges 32 of the side plates 31 of the neck portion 30 can be dealt with only by changing a design so that a width of the development part constituting the neck portion 30 is widened by a predetermined amount in a die of a press machine for cutting the development shape of the female terminal F shown in FIGS. 1 and 2 from the metal plate as a base material.

Further, an increase in the areas of the side plates 31 can be covered by parts of the metal plate as the base material to be originally discarded after the cutting of the development shape. Thus, material cost is not increased.

Bending rigidity is increased as the upper edges 32 of the side plates 31 are set higher in the neck portion 30. On the other hand, in the female terminal F of this embodiment, the rear edge on the ceiling side of the main body portion 10 is locked by the retainer to be doubly locked. Thus, the height positions of the upper edges 32 particularly on the front end side are limited to allow the retainer to escape.

In this embodiment, the upper edges 32 of the side plates 31 are formed to extend with an upward inclination toward the front ends from the starting ends (rear ends) after setting the front ends of the upper edges 32 of the side plates 31 of the neck portion 30 at highest positions where the front ends do not interfere with the retainer. By inclining the upper edges 32, stress concentration at intermediate positions of the upper edges 32 is avoided. Specifically, strength against the breakage of the neck portion 30 and the like can be maximally enhanced while ensuring a locking function of the retainer.

Further, if the insulated wire W is pulled in a state where this female terminal F is accommodated in the cavity of the housing and the retainer locks and retains the main body portion 10, a tensile stress acts on the neck portion 30 of the female terminal F. Here, since the upper edges 32 of the side plates 31 of the neck portion 30 are formed to extend with a more moderate inclination in this embodiment than in the comparative example, a stress change in the front-back direction in the neck portion 30 is smaller than in the comparative example. As a result, tensile strength of the neck portion 30 can also be improved.

Note that a collective waterproof connector is known as an example of a waterproof connector to which female terminals of this type are applied. This connector is structured such that a one-piece rubber plug formed with insertion holes, through which wires can be tightly inserted in correspondence with cavities, is placed in contact with the rear surface of a housing formed with a plurality of arrayed cavities into which female terminals are to be inserted. Each female terminal connected to an end of a wire is pushed and inserted into the cavity while resiliently widening the corresponding insertion hole of the one-piece rubber plug and held in close contact with the outer periphery of the wire due to the insertion hole reduced in diameter by the action of a resilient restoring force while the female terminal exits the insertion hole and is properly inserted into the cavity, with the result that the rear surface side of each cavity is sealed altogether.

Here, in the female terminal 1 shown in FIG. 7 as the comparative example, the tip of the core Wa leaps up when the wire barrel 2 is caulked while forming the bell mouths 2A, particularly the front bell mouth 2A. If the amount of leaping is large, the tip of the core Wa may project beyond the upper edges of the side plates 6 of the neck portion 4 in a posture facing obliquely upward.

On the other hand, more specifically looking at an event of pushing the female terminal 1 into the insertion hole of the one-piece rubber plug, the main body portion (denoted by no reference sign) in the form of a rectangular tube of the female terminal 1 is first pushed while widening the insertion hole with the front end side in the lead, the insertion hole is gradually reduced in diameter due to the resilient restoring force from a rear edge side as the rear edge of the main body portion moves forward away from the rear edge of the insertion hole and, subsequently, the neck portion 4 and the wire barrel 2 are inserted.

Here, if the tip of the core Wa is projecting beyond the upper edges of the side plates 6 of the neck portion 4 as described above, the leapt-up tip of the core Wa may damage such as by piercing a hole edge part, particularly an upper rear edge part, on the rear end of the insertion hole reduced in diameter after the passage of the rear edge of the main body portion.

Contrary to that, since the upper edges 32 of the side plates 31 of the neck portion 30 are elevated in the female terminal F of this embodiment as shown in FIG. 6, the tip of the core Wa stays below the upper edges 32 of the side plates 31 of the neck portion 30 even if the tip of the core Wa leaps up as the wire barrel 21 is caulked.

Thus, when the female terminal F is pushed into the insertion hole of the one-piece rubber plug and the rear edge of the insertion hole is reduced in diameter as the rear edge of the main body portion 10 passes as described above, the amount of reduction in diameter is limited due to contact with the upper edges 32 of the side plates 31 of the neck portion 30 and interference with the leapt-up tip of the core Wa is avoided. Specifically, the damage of the hole edge part of the rear end of the insertion hole is prevented.

The present invention is not limited to the above described and illustrated embodiment. For example, the following embodiments are also included in the technical scope of the present invention.

Only the wire barrel to be caulked and crimped to the core of the wire may be provided as the crimping portion.

The wire barrel may be a closed barrel closed into a tubular shape in advance.

The present invention can be similarly applied to a male terminal without being limited to the female terminal illustrated in the above embodiment.

LIST OF REFERENCE SIGNS

F . . . female terminal (terminal fitting)
W . . . insulated wire
Wa . . . core (wire)
10 . . . main body portion
11 . . . bottom plate
21 . . . wire barrel (crimping portion)
21A . . . barrel piece
25 . . . bell mouth
25A . . . top
30 . . . neck portion
31 . . . side plate
32 . . . upper edge

The invention claimed is:

1. A terminal fitting having opposite front and rear ends, the terminal fitting comprising:

a main body portion in the form of a rectangular tube and disposed at the front end of the terminal fitting;

a crimping portion rearward of the main body portion and being crimped to an end of a wire and squeezed to provide a bell mouth on a front end of the crimping portion, the bell mouth being outwardly flared; and a substantially U-shaped neck portion having a front end connected to the main body portion and a rear end connected to the crimping portion, the neck portion having a bottom plate and side plates standing up from opposite side of the bottom plate, the side plates of the neck portion having upper edges with rear ends at the bell mouth and front ends at the main body portion, the rear ends of the upper edges of the side plates being aligned in a height direction with the outwardly flared bell mouth and the upper edges of the side plates of the neck portion being inclined to gradually and continuously increase in height from the rear end to the front end of the upper edges.

2. The terminal fitting of claim 1, wherein the crimping portion is an open barrel, in which barrel pieces stand up from opposite side edges of a bottom plate, and are caulked and crimped into a substantially heart shape such that projecting edges of the both barrel pieces bite into the wire while butting against each other by being squeezed between an anvil and a crimper after the wire is placed on the bottom plate, and the bell mouth is formed at least on the front end.

3. The terminal fitting of claim 1, wherein the front ends of the upper edges of the side plates of the neck portion curve up and merge into rear ends of side plates of the main body portion.

4. The terminal fitting of claim 1, wherein a slope of the bell mouth is greater than a slope of the upper edges of the side plates adjacent the bell mouth.

5. The terminal fitting of claim 1, wherein the crimping portion has a wire barrel adjacent the neck portion, the wire barrel, the neck portion and the main body portion having equal widths.

* * * * *